United States Patent [19]

Segovia

[11] Patent Number: 5,016,928

[45] Date of Patent: May 21, 1991

[54] GATE LOCKING MECHANISM

[76] Inventor: Jose F. Segovia, 509 Bayonne, Laredo, Tex. 78041

[21] Appl. No.: 514,264

[22] Filed: Apr. 25, 1990

[51] Int. Cl.[5] ..... E05C 5/02; E05C 3/04

[52] U.S. Cl. ..... 292/213; 292/205

[58] Field of Search ..... 292/213, 218, 205, 116, 292/120, 104, 148, 304

[56] References Cited

U.S. PATENT DOCUMENTS

| | | | |
|---|---|---|---|
| 739,701 | 9/1903 | McLaughlin | 292/104 |
| 2,940,790 | 6/1960 | Ingalls et al. | 292/148 |
| 3,174,314 | 3/1965 | Johnson | 292/148 X |
| 3,989,288 | 11/1976 | Schuller | 292/213 |
| 4,387,916 | 6/1983 | Lening et al. | 292/205 X |

*Primary Examiner*—Richard E. Moore

*Attorney, Agent, or Firm*—Richard C. Litman

[57] ABSTRACT

A gate locking mechanism includes an oarlock pivotally connected to an arm mounted upon a gate post to allow vertically displacement of the spaced apart arms of the oarlock, to and from captive relationship with a fence end post. The gate is secured in a closed position by passing a locking device through aligned openings in a lock tab on the oarlock and in a flange projecting from a lock collar mounted upon the fence end post. By mounting at least the lock collar in a manner to permit sliding and arcuate displacement about its post, the lock collar flange is shiftable to and from its cooperative relationship with the oarlock tab to provide a clear pathway when the gate is opened. In an alternate embodiment, the oarlock is substituted by another slidable and arcuately displaceable member having an apertured flange sliftable to allow insertion of a locking device through the flanges of both members mounted upon the two posts.

7 Claims, 2 Drawing Sheets

FIG. 3
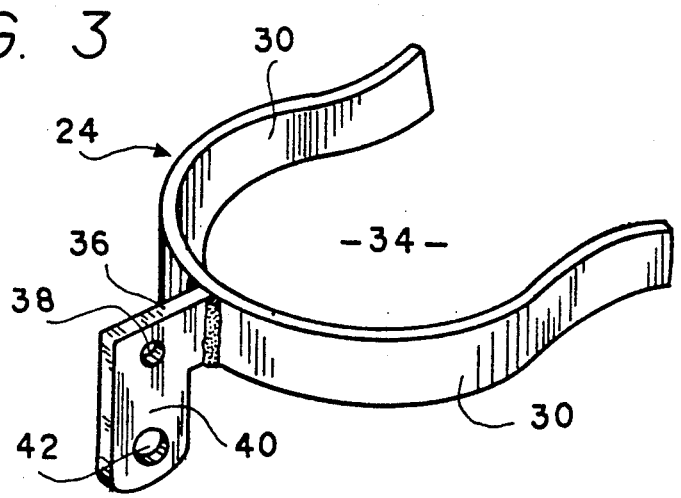
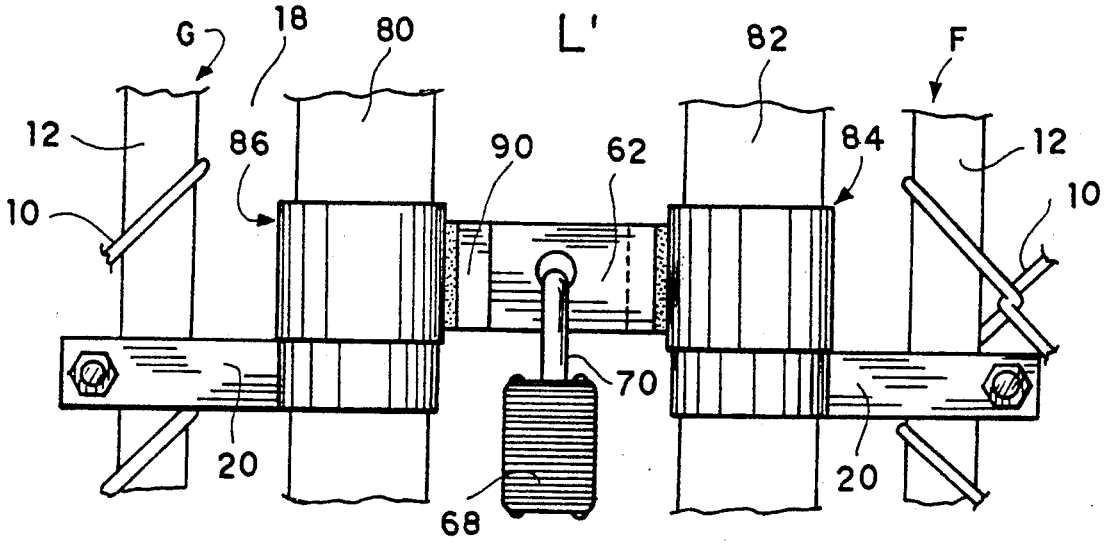
FIG. 4
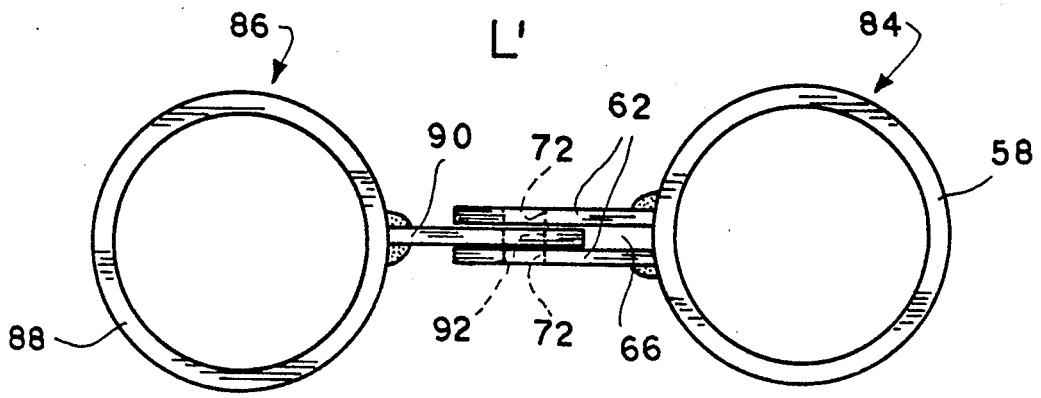
FIG. 5

GATE LOCKING MECHANISM

FIELD OF INVENTION

This invention relates generally to latches for securing doors and more particularly to a two piece gate lock for chain link fences.

BACKGROUND OF THE INVENTION

Chain link fences are made of a pipe support frame with a mesh of thick metal wire forming the main barrier of the fence. The metal wire screen is held to the frame by pieces of wire surrounding the frame work at fixed intervals. To provide a gate in an opening of the chain link fence, a pipe work frame the size of the opening is hinged to one side of the opening. An oarlock is hingeably attached to the opposite side of the gate frame. When the gate is in the closed position, the oarlock is moved to a horizontal position where it receives an end fence post in a U-shaped portion.

DESCRIPTION OF THE RELATED ART

Locking the gate requires that openings be provided in the oarlock and the collar holding the oar lock. When the oarlock is lowered to the horizontal position the openings line up and a padlock or other locking mechanism can be passed through the openings to lock the gate to the fence post. Gate locking assemblies providing this type of fastening are shown in U.S. Pat. No. 4,387,916 issued to Lening et al. and U.S. Pat. No. 4,691,541 issued to McQuade, Sr.

The drawback of these locking devices is that the entire burden of locking the gate is placed on the oarlock. The oarlock is only attached to the gate via a metal collar. A good push on either side of the gate will twist the oarlock and force the gate to open. To form a secure lock a chain must be wrapped around both the gate and fence post. None of the above listed patents are seen to disclose the specific arrangement of concepts disclosed by the present invention.

SUMMARY OF THE INVENTION

By the present invention, an improved gate locking assembly is disclosed to eliminate the drawbacks in the prior art. This invention creates a physical bond between the gate and the fence to prevent any unauthorized opening of the gate. This bond is formed by two collars, one attached to the gate and the other attached to the fence. The collars contain corresponding openings that when aligned provide an aperture for a padlock or other similar locking device to be passed through.

Accordingly, one of the objects of the present invention is to provide an improved gate locking assembly designed to resist unauthorized opening of the gate.

Another object of the present invention is to provide a gate lock that creates a physical bond between the gate and the fence.

A still further object of the present invention is to provide a two piece collar gate lock wherein the collars are rotatable about the gate and fence posts, and can be swung out of the way when not in use to avoid collision with traffic passing through the gate.

Yet another object of the present invention is to provide a gate lock using two similar collar devices for the locking mechanism, to provide an alternative for individuals who wish to retain their present oarlock.

With these and other objects in view which will more readily appear as the nature of the invention is better understood, the invention consists in the novel combination and assembly of parts hereinafter more fully described, illustrated and claimed with reference being made to the attached drawings.

BRIEF DESCRIPTION OF THE DRAWINGS

FIG. 3 is a top perspective view of the pivotal oarlock member;

FIG. 4 is a fragmentary side elevation of an alternate embodiment of the gate locking mechanism; and FIG. 5 is a top plan view of the cooperating components of the locking mechanism shown in FIG. 4.

Similar reference characters designate corresponding parts throughout the several figures of the drawings.

DESCRIPTION OF THE PREFERRED EMBODIMENT

Figure 1:
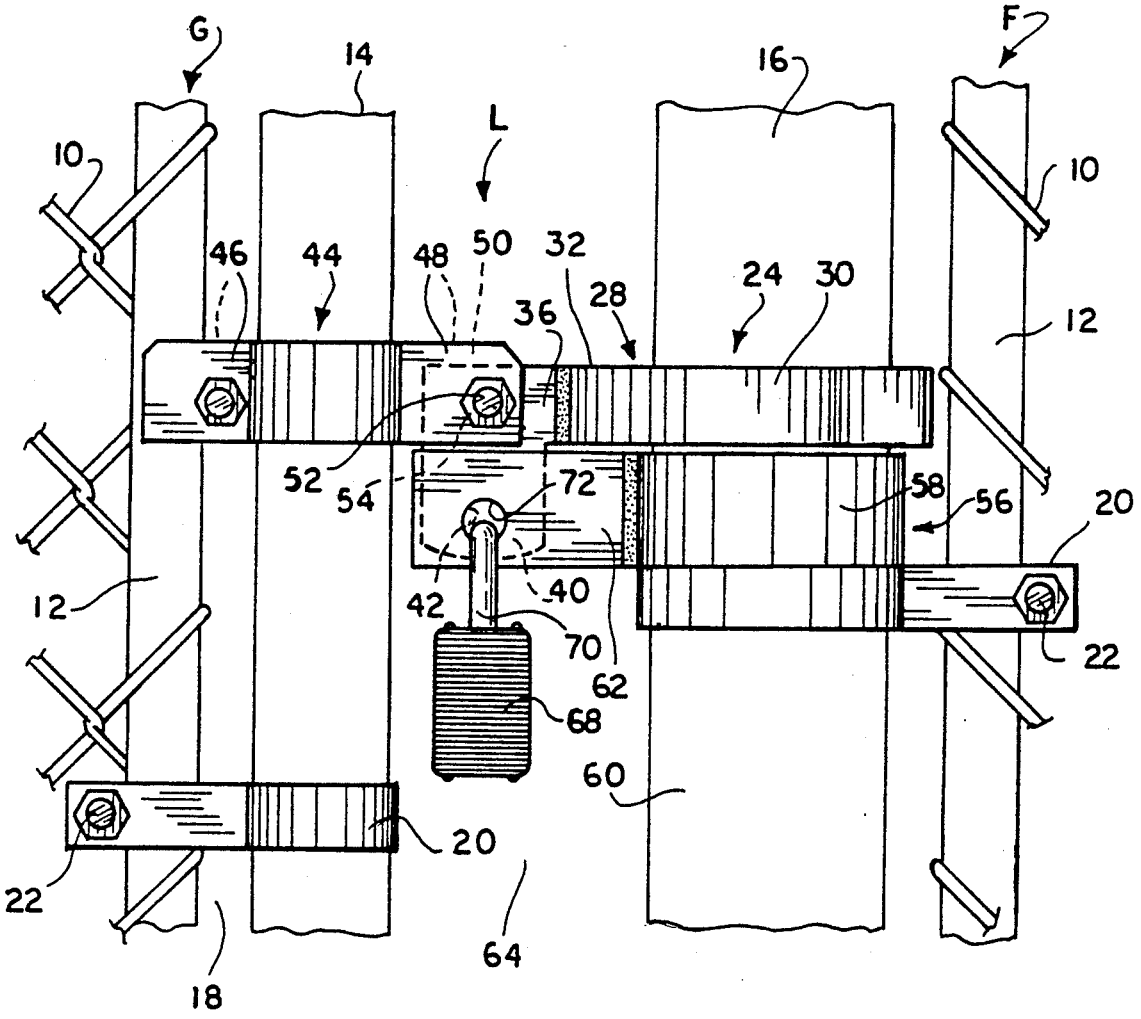
FIG. 1 is a fragmentary side elevation of the gate locking mechanism as it appears in the secured position.
Figure 2:
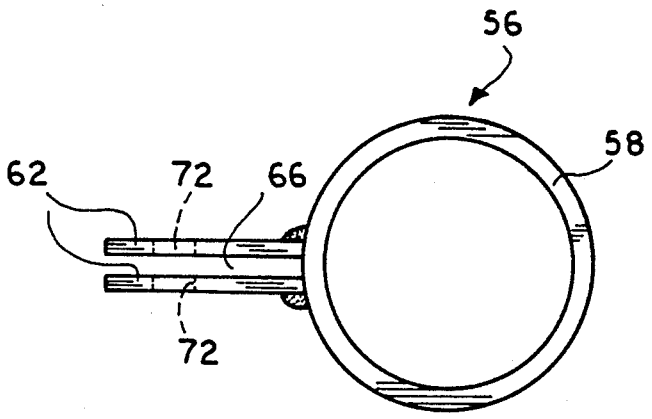
FIG. 2 is a top plan view of the slidable lock collar as carried by a fence end post.

Referring now to the drawings, particularly FIG. 1, the present invention will be understood to relate to an improved locking mechanism generally designated L and which serves to securely retain a swinging gate G in a closed position relative an adjacent stationary fence section F. The specific fencing itself is immaterial since the instant locking mechanism may be employed to secure any moving gate relative to a stationary post. Typically, the fencing may comprise woven wire screen 10, the ends of which are retained by stretcher bars 12 respectively fixedly attached to both the gate post 14 and fence posts, including the fence end post 16 adjacent the gate opening 18. Suitable fencing clamps 20, encircling each post are secured about the adjacent stretcher bars 12 by removable fasteners 22.

The locking mechanism L utilizes an oarlock 24 pivotally carried by a gate clamp 44 and which cooperates with the stationary fence end post 16. The oarlock 24, as shown in FIGS. 1 and 3, includes a substantially U-shaped post engaging member 28 having a pair of spaced apart arms 30—30 extending from a curved base portion 32 and defining a post-engaging opening 34 therebetween. Projecting outwardly from the medial area of the base portion 32 is a mounting flange 36 provided with a pivot opening 38. As will be seen in FIG. 1, a locking tab 40 depends from the mounting flange 36 and includes an enlarged lock receiving opening 42.

The oarlock 24 is affixed to the swinging gate G by means of the gate clamp 44 comprising either a unitary or multi-part member presenting a pair of arms 46—46 encircling the gate post 14 and terminating in parallel end portions 48—48 slightly spaced apart to form a vertically disposed slot or opening 50. The lateral extent of this opening 50 is selected to provide a close, interference-free fit of the oarlock mounting flange 36 therein and which is captively retained for pivotal displacement, by means of the fastener 52. This fastener will be understood to pass through aligned openings 54—54 in the gate clamp end portions 48 and the pivot opening 38 in the oarlock mounting flange 36.

The structure as above described will be seen to provide solely a catch mechanism when the oarlock 24 is pivoted to a horizontal position with the fence post 16 disposed within the opening 34 as shown in FIG. 1. To provide for a locking of the thus located gate G, means must be employed to immobilize the oarlock 24 in this horizontal position. Accordingly, a lock collar member 56 is mounted upon the stationary fence end post 16 and includes a sleeve 58 having an internal diameter selected to insure a freely movable fit about the periphery 60 of the fence post 16. A pair of parallel, spaced apart flanges 62—62 radially project from the sleeve 58 and are of a length substantially spanning the width of the gap 64 between the closed gate G and fence end post 16, without abutting the gate post 14. The clearance 66 formed between the lock member flanges 62—62 is selected to insure free vertical movement of the oarlock tab 40 therein as it is pivotally displaced about the fastener 52.

As above described, the lock collar member 56 is freely mounted about the fence end post periphery 60. To retain this member in a fixed horizontal plane, stop means are provided on the post 16 at an elevation to offer a seat allowing for selective angular displacement of the collar member 56 while maintaining it in a fixed plane. Without having to provide a separate, additional member, one of the fencing clamps 20 may be used as shown in FIG. 1. With this arrangement, a user will be able to push the collar flanges 62—62 out of the way of the gate opening 18 and gap 64 when the locking feature of the invention is not being used and the gate G is opened, thereby removing any projecting structure from the gate opening which would otherwise strike or interfere with unencumbered passage through the opened gate.

In the operation of the above related locking mechanism L, the gate G is closed, during which the oarlock 24 is positioned with the post engaging member 28 disposed in a substantially vertical plane. With the gate post 14 located adjacent the fence end post 16 as in FIG. 1, the oarlock 24 is pivoted about its fastener 52 to a horizontal plane with the fence post 16 contained within its opening 34. Before this latter manipulation, the lock collar member 56 is angularly displaced to locate its flanges 62—62 and the clearance 66 therebetween, immediately beneath the oarlock pivot as formed by the fastener 52. This action assures that as the oarlock if lowered to the position of FIG. 1, its depending lock tab 40 will enter the clearance 66 between the lock collar member flanges 62—62. At this point, a more secure interengagement between the gate and fence is obtained than would be provided if only the oarlock were utilized. This is due to the extra retention as offered by the flat extent of the lock tab 40 captively engaged within the lock collar member clearance 66 and which will absorb and transmit a portion of any transverse forces applied to the gate, through the sleeve 58 and to the fence post 16.

To achieve a secured interlock between the above closed gate G and the fence end post 16, an appropriate controllable, removable locking device, such as a padlock 68 or the like, is applied to preclude unwanted disengagement between the interlocked oarlock 24 and lock collar member 56. In this respect, the shank 70 or other portion of the selected locking device 68 is passed through aligned openings 72—72 in the collar member flanges 62—62 as well as the intermediate opening 42 of the contained oarlock tab 40.

If it is desired to avoid the use of a pivoted oarlock, a lockable gate latch L' as shown in FIGS. 4 and 5 may be used. In this embodiment, the juxtaposed gate post 80 and fence end post 82 are both supplied with lock collar members slidably mounted about the respective posts. At least one of these collar members 84 is similar to the collar member 56 previously described while the other collar member 86 preferably includes a sleeve 88 from which radiates but a single flange 90 having an opening 92 therethrough. The width of the flange 90 is selected to provide a close vertically slidable fit within the clearance 66 of the cooperating collar member 84. With this arrangement, stop means are provided on each post for both collar members 84, 86, such as the fencing clamps 20—20 as shown in FIG. 4. These clamps are affixed in a common plane so that the two collar members, when resting thereupon, will likewise be coplanar. In this manner, as the gate G is being closed, the gate collar member 86 is momentarily elevated about the gate post 80 until the gate is closed and thereafter lowered as in FIG. 4, with its flange 90 disposed within the clearance 66 of the post collar member 84, following which a locking device 68 may be applied through the aligned openings in the three flanges. When the locking feature is not being used and when the gate G is opened again, at least the fence post collar member 84 may be arcuately moved out of the pathway of the gate opening 18.

I claim:

1. In a locking mechanism for a gate having a gate post and adapted to be moved to close a gate opening adjacent a fence end post, the improvement comprising;

a gate arm affixed to said gate post and provided with an outwardly projecting end portion having an opening therethrough, an oarlock including a substantially U-shaped post engaging member having a pair of spaced apart arms joined to a base portion, a mounting flange projecting from said base portion and provided with an opening therethrough, a lock tab depending from said mounting flange and having an opening therethrough, pivot means joining said oarlock to said gate arm end portion, said pivot means passing through said gate arm end portion opening and said mounting flange opening, a lock collar mounted upon said fence end post in a plane beneath said oarlock mounting flange, a flange projecting from said lock collar and having an opening therethrough, said oarlock displaceable about said pivot means to capture said fence end post therebetween with said lock tab thereupon being juxtapositioned said lock collar flange with said lock tab and lock collar flange openings coaxially aligned, whereby a removable locking device is capable of being inserted through said aligned openings to preclude vertical displacement of said oarlock about said pivot means to thwart opening of said gate relative said fence end post.

2. In a locking mechanism for a gate having a gate post and adapted to be moved to close a gate opening adjacent a fence end post, the improvement comprising:

a gate arm slidably and arcuately mounted upon said gate post and provided with an outwardly projecting end portion having an opening therethrough, a lock collar slidably and arcuately mounted upon said fence end post, a flange projecting from said lock collar and having an opening therethrough, stop means on said fence end post adapted to support said lock collar in a plane juxtaposed said gate arm end portion, said lock collar when engaging said stop means arcuately displaceable to position said flange adjacent said gate arm end portion with said openings coaxially aligned, whereby a removable locking device is capable of being inserted through said aligned openings to interlock said gate arm and lock collar to thwart opening of said gate relative said fence end post.

3. A locking mechanism for a gate according to claim 1 wherein, said lock collar is arcuately displaceable about said fence end post.

4. A locking mechanism for a gate according to claim 1 wherein, said lock collar is vertically displaceable about said fence end post, and stop means on said fence end post limiting vertical displacement of said lock collar.

5. A locking mechanism for a gate according to claim 1 wherein, said lock collar includes a pair of said flanges, and said pair of flanges disposed in a parallel spaced apart manner defining a clearance therebetween closely receiving said oarlock lock tab.

6. A locking mechanism for a gate according to claim 2 wherein, said gate arm is slidably and arcuately displaceable about said gate post, and stop means on said gate post engageable with said gate arm to limit vertical displacement thereof.

7. A locking mechanism for a gate according to claim 2 including, a pair of said flanges projecting from said lock collar, and said pair of flanges disposed in a parallel spaced apart manner defining a clearance therebetween closely receiving said gate arm end portion.

* * * * *